United States Patent [19]

Szabo

[11] Patent Number: 4,583,882

[45] Date of Patent: Apr. 22, 1986

[54] METHOD FOR FORMING ARTIFICIAL ISLANDS

[76] Inventor: Miklos T. Szabo, 301 Thornberry Court Dr., Pittsburgh, Pa. 15237

[21] Appl. No.: 575,893

[22] Filed: Feb. 1, 1984

[51] Int. Cl.[4] ..... E02D 21/00

[52] U.S. Cl. ..... 405/217; 405/195; 264/298

[58] Field of Search ..... 405/60.17, 158, 217, 405/11-14, 63, 156, 195; 264/298

[56] References Cited

U.S. PATENT DOCUMENTS

| | | | |
|---|---|---|---|
| 2,718,684 | 9/1955 | Bjorksten | 405/156 X |
| 3,555,573 | 1/1971 | Turner | 264/298 X |
| 3,643,741 | 2/1972 | Mirarda . | |
| 3,675,430 | 7/1972 | Haimila | 405/217 |
| 3,738,114 | 6/1973 | Bishop | 405/217 |
| 3,768,266 | 10/1973 | Glenn | 405/17 |
| 3,798,912 | 3/1974 | Best et al. . | |
| 3,803,852 | 4/1974 | Fernandez-Luque et al. . | |
| 3,842,607 | 10/1974 | Kelseaux et al. . | |
| 3,861,157 | 1/1975 | Hillen . | |
| 3,990,252 | 11/1976 | Louden . | |
| 4,009,580 | 3/1977 | Dowse . | |
| 4,072,017 | 2/1978 | Shiraki . | |
| 4,103,502 | 8/1978 | Cashman . | |
| 4,266,889 | 5/1981 | Rail et al. . | |
| 4,279,855 | 7/1981 | Ward | 264/298 |
| 4,320,992 | 3/1982 | Baldridge et al. . | |

FOREIGN PATENT DOCUMENTS

| | | | |
|---|---|---|---|
| 1269182 | 7/1961 | France | 405/158 |
| 809180 | 2/1959 | United Kingdom | 264/298 |

OTHER PUBLICATIONS

"How Imperial Built First Arctic Island", Riley, J. G., *Petroleum Engineer,* Jan. 1974 pp. 25-28.

"How to Drill and Produce in the Beaufort Sea", Bleakley, W. B., *Offshore Engineering and Technology,* by Energy Publications, 1982 pp. 25-29.

"Panarctic Pushes Ahead With Arctic Drilling Program", Moore, S. D., *Petroleum Engineer International,* Feb. 1983, pp. 26-34.

"Sand Island Nears Prototype Stage" *Petroleum Engineers,* Apr. 1976 p. 14.

"Experience that Adds up to the Ability to Fabricate a 9000t Steel Caisson in just 5 Months"—advertisement of Hitachi Zosen.

"Gulf Canada Moves Ahead With Unique Drilling System" Moore, S. D., *Petroleum Engineer International,* Dec. 1982, pp. 40-44.

"Improving Offshore Structures Promote Arctic Development", Bruce, J. C., *Petroleum Engineer International,* May 1983, pp. 44-54.

*Primary Examiner*—Dennis L. Taylor

*Attorney, Agent, or Firm*—Parmelee, Miller, Welsh & Kratz

[57] ABSTRACT

The formation of an artificial island in a body of water is effected by injecting a gellable, cross-linkable fluid, such as a blend of a water-soluble polymer and a cross-linking agent therefore, from a vessel below the surface of the water and moving the vessel to form a strip of a gelled mass. The gellable fluid is injected such that it extends from the floor of the body of water to the surface thereof. A dense solid material may be incorporated in the gellable fluid. An exposed section may be formed on the strip by either injecting a gas along with the gellable fluid in the upper region thereof, or pouring additional gellable fluid over the formed strip prior to complete setting of the surface of the gellable mass. The strip may be formed to enclose a section of water and the water in said enclosed section may be displaced with solid load-bearing material, or ice may be built up within the enclosed section to serve as a load supportive structure.

19 Claims, 11 Drawing Figures

METHOD FOR FORMING ARTIFICIAL ISLANDS

BACKGROUND OF THE INVENTION

The present invention relates to a process for formation of breakwaters or artificial islands in a body of water.

In the offshore drilling industry, a much more complicated and expensive operation results, compared to onshore drilling. The various drilling and production facilities must withstand severe environmental conditions; high winds, various types of waves, currents and sometimes, floating ice masses. In an effort to solve these problems, the formation of artificial islands in a body of water has been proposed, with the drilling or other equipment supported on a load supportive mass.

As examples of such artificial islands, Imperial Oil Ltd. built an artificial island in Mackenzie Bay using 400,000 cubic yards of granular fill. The island was protected against erosion and ice pile-up with a large slanted slope protection area. The slope protection area was covered with a torpedo net and filter cloth. Exxon also built an artificial island in the Mackenzie Bay area in 43 feet of water. The technique involved the use of a large volume of granular fill. The edges of the island are slanted and the slopes are protected with sandbags and filter cloths. Panarctic Oils Ltd. uses an ice platform for drilling wells in the Canadian Arctic Islands area. The nearness to the North Pole allows Panarctic to form three inches of ice per day in a given area. As the thickness of the ice grows, the ice mass formed submerges. In 40–80 days, in the coldest part of the winter, the thickness of the ice mass reaches a level of buoyancy at which it can carry the entire load of drilling equipment. Drilling time is usually from January to mid-May.

Other examples of artificial island building, and land supportive masses, are disclosed in the patent literature. In U.S. Pat. No. 4,009,580, an impervious membrane is floated to a site and attached to a floating structure. The membrane is expanded by filling it with water and then sand is used to displace the water from the membrane and build an island. The contained sand is drained to remove enough water to provide external pressure on the membrane to confine the sand. Such a structure does not appear to be strong enough to withstand hostile environmental conditions such as high winds, currents and ice movements. The floatable top could be displaced from the base due to the action of waves, currents and particularly a large ice sheet. Confining pressure within an ice body can be great enough to rupture the floatable structure. If the floatable structure is designed to be strong enough, the concept reverts to a floating caisson-type structure. Any rupture of the membrane could create an unsafe condition. U.S. Pat. No. 4,103,502 teaches a similar approach where specific drainage tubes are present in the sand mass.

U.S. Pat. No. 3,798,912 teaches formation of a mobile artificial island which shows a flexible neoprene or nylon barrier.

In U.S. Pat. No. 3,842,607, a silt slurry, used for building permafrost islands of sand and gravel, is mixed with a thickenner such as sodium silicate or xanthum gum. These materials are admixed and deposited on an island being built, after sand and gravel have been piled to a satisfactory height above the surface of the water. The slurry has a silt content in the range of about 60 to 80 weight percent.

In U.S. Pat. No. 3,990,252 dredgings from the floor of a body of water are admixed with hydraulic cement and soluble alkali silicate to form an island perimeter.

SUMMARY OF THE INVENTION

An artificial island is formed in a body of water by injecting a gellable fluid, preferably comprising a blend of a solution of a water-soluble, cross-linkable polymer, and a solution of a cross-linking agent therefor, from a vessel travelling on the water, below the surface of the water to form a gelled mass extending from the floor of the body of water to the surface thereof and moving the vessel to form a strip of gelled mass. The gelled mass may have a dense solid material incorporated therein to insure a density of the mass greater than that of the water. Preferably, the cross-section of the gelled mass adjacent the floor of the body of water is greater than the cross-section of the gelled mass adjacent the surface. A further supply of a blend of the water-soluble polymer and cross-linking agent solutions is poured on the surface of the gelled mass, prior to complete setting of the surface thereof, which forms a dome-shaped section, chemically bonded to the surface, extending from the body of water. Optionally, a gas may be injected along with the gellable fluid, in the upper portion of the mass formed to produce said dome-shaped section. In formation of a load supportive mass, the water within an enclosed section of water surrounded by a ring of gelled mass is displaced by solid material, such as sand, to provide an artificial island comprising a strip of gelled mass and a core of solid material.

DESCRIPTION OF THE DRAWINGS

In the drawings, which illustrate schematically the present process.

DETAILED DESCRIPTION

The present method for forming artificial islands uses a gel-dispersing waterborne vessel which moves along a body of water while dispersing a gel-forming mass that will reach from the floor of the body of water to the surface thereof.

The waterborne vessel is adapted to carry large volumes of a cross-linkable water-soluble polymer and a cross-linking agent for the polymer, equipment for dissolving said materials in water to form solutions thereof and a storage tank for partial aging of the blend formed, if desired, and disperse the partially aged blend below the surface of the body of water. The water-soluble polymer and the cross-linking agent, depending on the specific materials used, may be in dry, liquid (in solution) or in an emulsified form. Often, water-soluble polymers are in the form of an emulsion, containing surfactants. Upon dilution of the emulsion with water, the emulsion will break down and a solution of the water-soluble polymer is formed. Where an emulsified form of a polymer is to be used, the vessel would carry equipment that enables the pumping of the emulsion, from tanks containing the same, into a means for mixing the emulsion with water from the body of water.

The vessel will also carry any equipment necessary to contain a volume of the cross-linking agent and to dissolve the cross-linking agent in water from the body of water. The solution, so formed, would be introduced into a pump means which would inject the solution into a mixing means where the solution of cross-linking agent and solution polymer are homogeneously blended to provide the mass for gel formation.

The mixture of water-soluble polymer and cross-linking agent, after partial aging, if desired, is fed into the body of water through a series of injectors carried by the vessel. As the vessel travels along the body of water the blend is discharged from the injectors and a gel mass is formed, the gel mass resting upon the floor of the body of water and reaching to the surface thereof. The injection of the blend of partially aged water-soluble polymer and cross-linking agent is effected at a plurality of locations that results in a spaced injection such that the mixture blends with the water before full gellation and forms a stationery gel mass.

Figure 1:
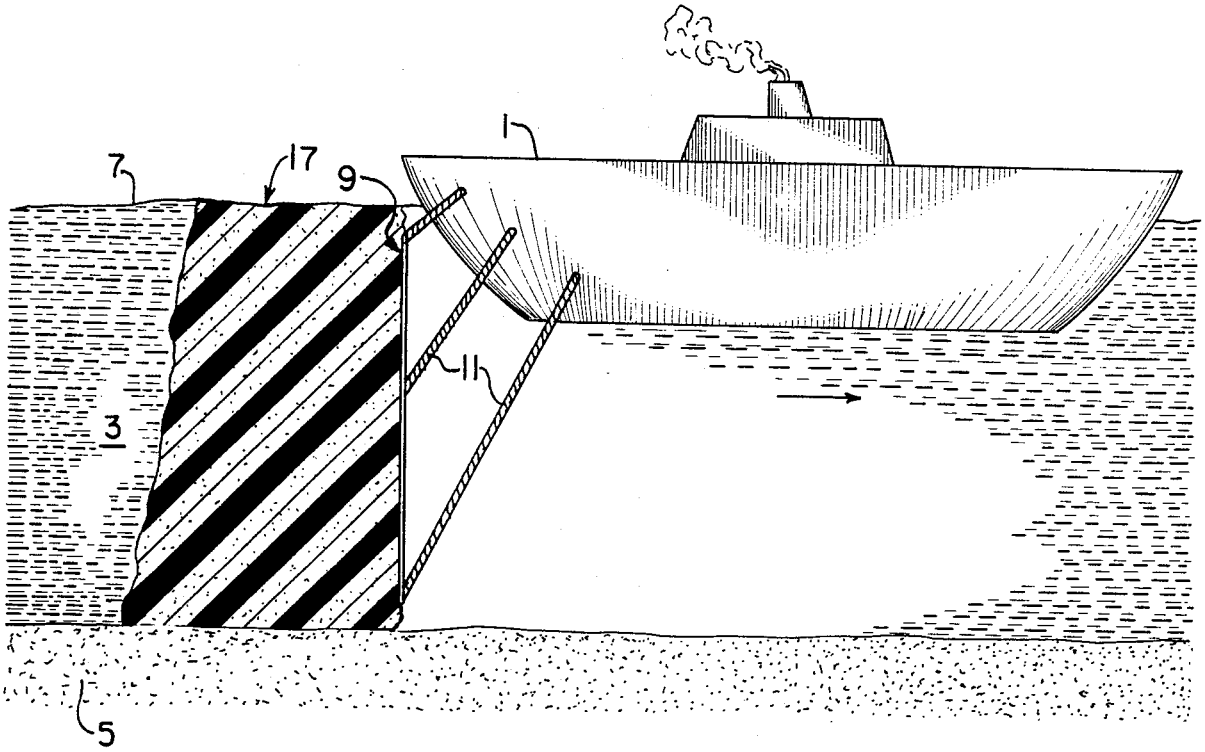
FIG. 1 illustrates a waterborne vessel carrying means for injecting a blend of a solution of a cross-linkable water-soluble polymer and a solution of a cross-linking agent into a body of water to form a gelled mass.
Figure 2:
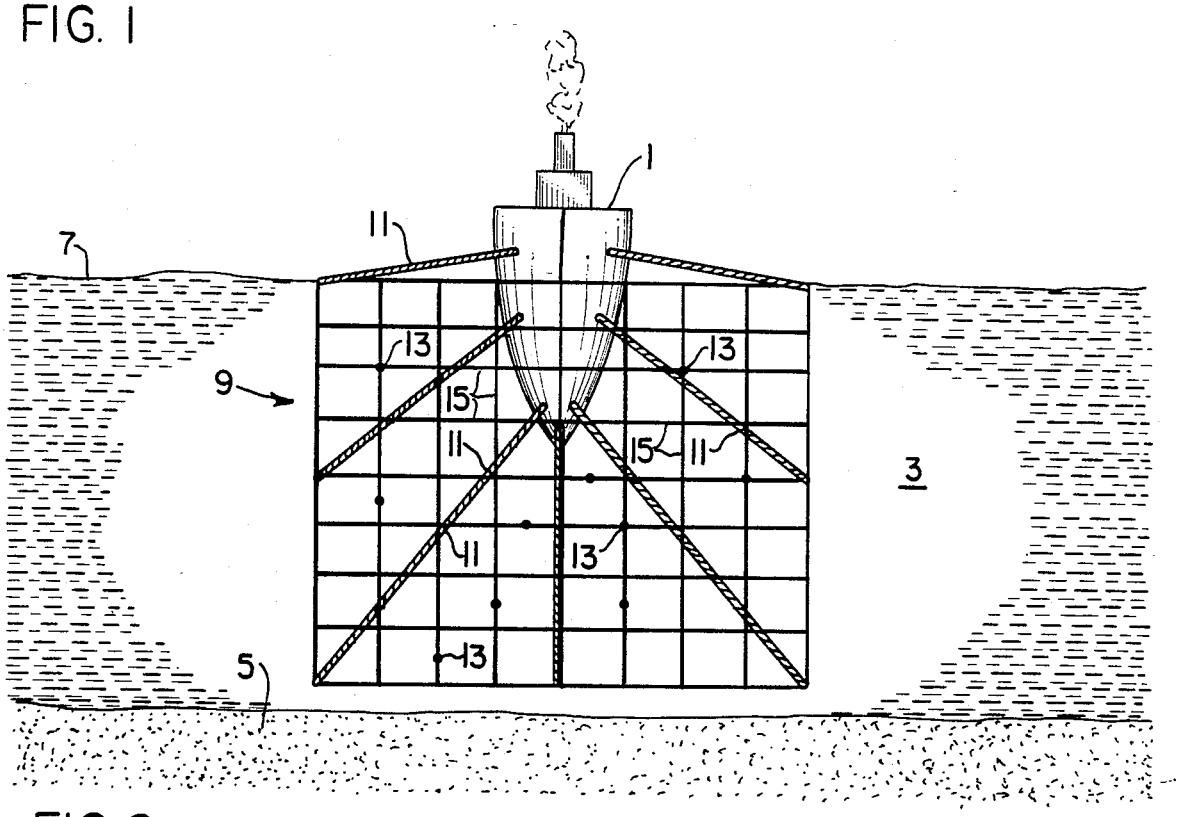
FIG. 2 is an illustration looking at the rear of the ship shown in FIG. 1.

Referring now to the drawings, FIG. 1 schematically illustrates a waterborne vessel 1, on a body of water 3, the body of water having a floor 5 and surface 7. The waterborne vessel, which contains a supply of water soluble polymer and a supply of a water soluble cross-linking agent therefore, has a means for injecting a blend of these reactants into the body of water 3. As illustrated in FIGS. 1 and 2, the means for injecting the gel forming blend comprise a framework 9, formed from metal or other material, which is carried by the vessel 1, and attached thereto by supports 11, the framework 9 having a plurality of injection nozzles 13 and conduits 15 leading from the vessel 1 to each of the injection nozzles 13. The conduits 15 are located along the framework 9 so as to provide the injection nozzles in a pattern which will result in the formation of a gel mass 17, within the body of water 3, that reaches from the floor 5 to the surface 7. As the vessel 1 moves, as indicated by the arrow in FIG. 1, a blend of the mixture of partially aged polymer and cross-linking agent solution and the water of the body of water results, and the coherent gel mass 17 is formed behind the vessel 1.

Figure 3:
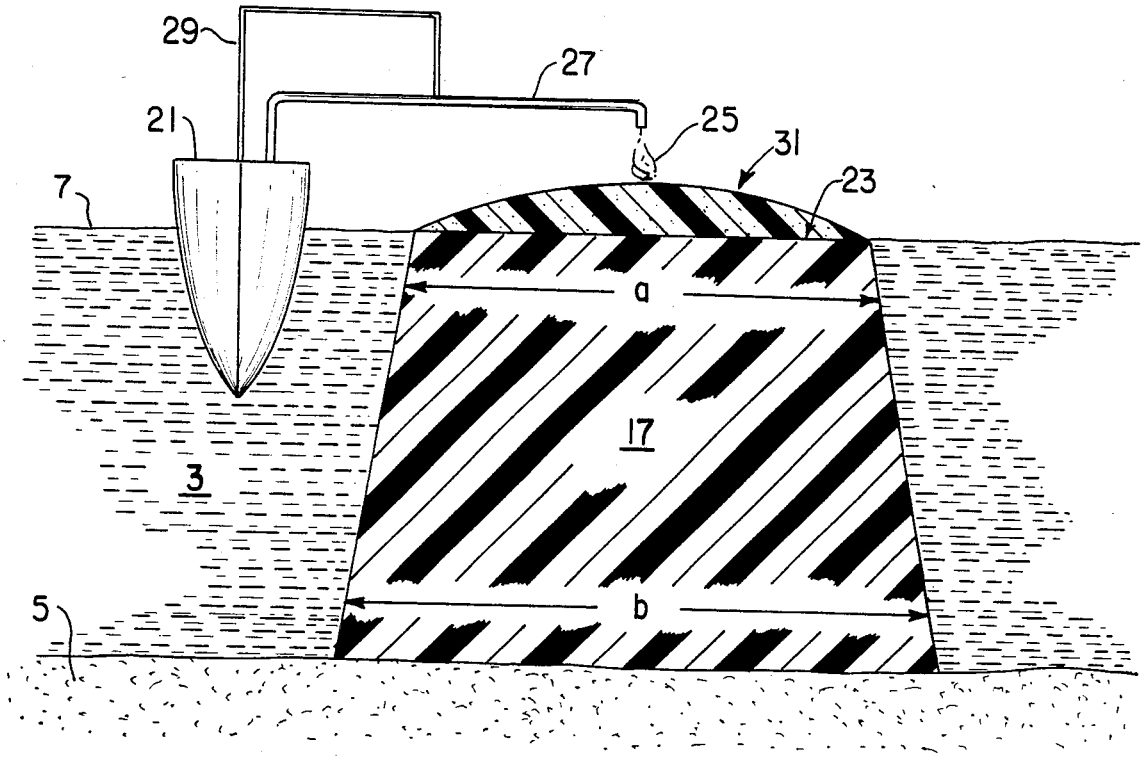
FIG. 3 illustrates the topping procedure where a blend of a cross-linking water soluble polymer solution and cross-linking agent solution is poured over a previously formed gelled mass prior to complete aging of the top surface of the gelled mass.

The cross-section of the gelled mass formed, which can be controlled by controlling the shape of the framework 9, or the location and use of various injection nozzles 13, may vary, but preferably the gelled mass is formed such that the cross-section b of the gelled mass adjacent the floor 5 of the body of water 3 is greater than the cross-section a of the gelled mass adjacent the surface 7 (FIG. 3).

Another embodiment of the present invention provides for "topping" of the gelled mass to provide an exposed section of gelled mass extending above the surface of the body of water, as illustrated in FIG. 3. As illustrated therein, a second vessel 21, follows the main ship 1 which is forming the gelled mass 17 that reaches from the floor 5, of the body of water 3, to the surface 7 thereof, at a predetermined distance, to the side of the gelled mass 17. This second vessel 21 carries a second supply of cross-linkable polymer and cross-linking agent therefor, means for dissolving these materials in water, and means for mixing these sections and partially aging the same. The partial aging is controlled to provide a partially aged pumpable fluid mass which has a high viscosity but wherein the cross-linking of the polymer is incomplete. Before the top surface 23 of the previously formed gelled mass 17 has completely set, the partially aged viscous fluid blend of polymer and cross-linking agent 25 from the second vessel 21 is pumped through a pipe 27, which may be supported by a boom 29, onto the top surface 23 of the gelled mass 17. Since the blend of polymer and cross-linking agent solutions along the top surface 23 of gelled mass 17 is not completely set, the blend of polymer and cross-linking agent solutions 25 discharged onto said top surface will chemically bond therewith and adhere to the top surface as an exposed gelled mass 31 extending from the body of water 3.

The discharged fluid mass 25, because of its high viscosity will not readily spread over the edges of the partially aged top surface 23 of the gelled mass 17. Still being in a flowable state, however, the mass will spread gradually towards the edges of the top surface 23, while the cross-linking reaction rapidly continues to completion. The exposed gelled mass 31, which is thus chemically bonded to the gelled mass 17, will generally be dome shaped, with the central section preferably extending several feet above the surface 7 of the body of water 3. In formation of the gelled mass in a sea environment, the exposed gelled mass 31 will assure a more effective breaking of waves. Another purpose of the topping operation is to provide a barrier against floating ice sheets where the gelled mass is formed in bodies of water subjected to such ice flows. Since the exposed gelled mass 31 will have a domed shape with sloping sides, it will have the capacity to ridge such ice sheets.

While the above description refers to formation of the topping or exposed gelled mass 31 from a separate vessel, it is to be understood that such can also be formed using the main ship 1, with partially set gellable fluid 25 prepared from the rear portion of the main ship and deposited onto the partially gelled top surface 23 of the gelled mass 17.

Figure 4:
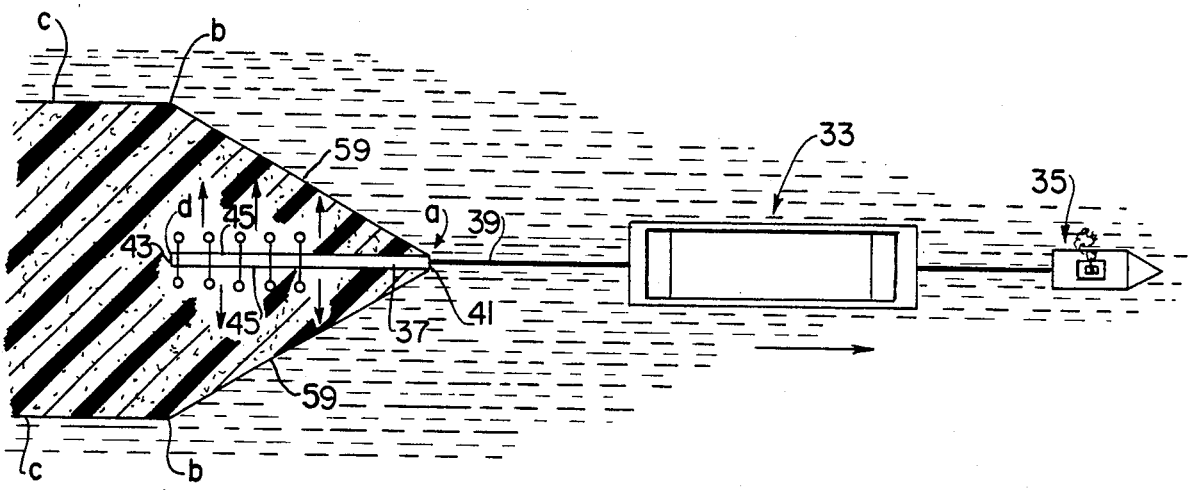
FIG. 4 illustrates a plan view of another embodiment of the injection system using a barge with means for injecting a gas along with the gellable fluid into the body of water.
Figure 5:
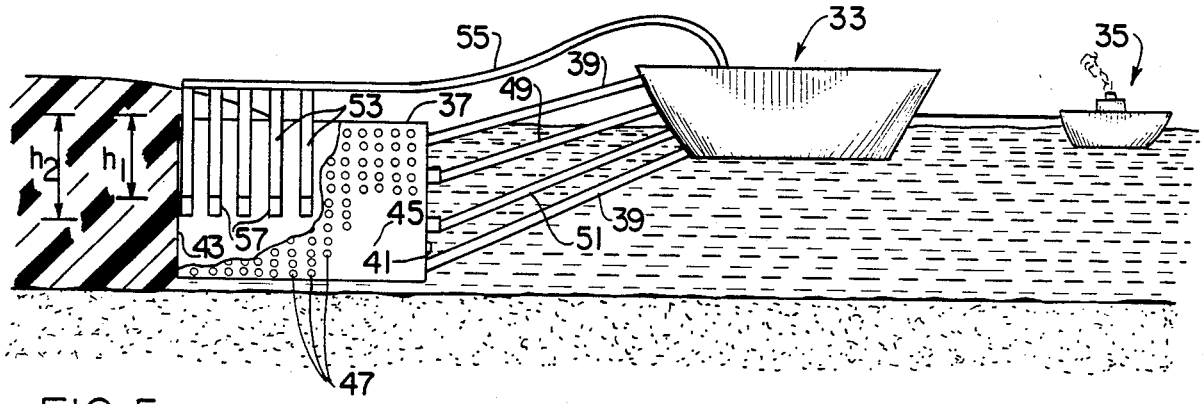
FIG. 5 is a side view of the embodiment illustrated in FIG. 4.
Figure 6:
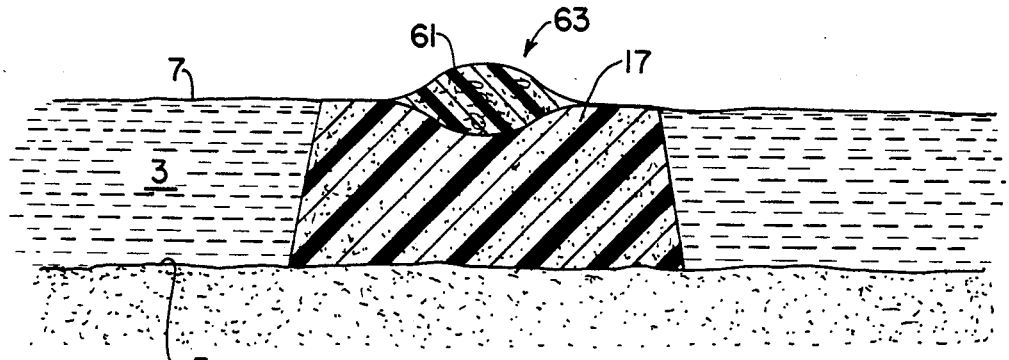
FIG. 6 illustrates a gelled mass produced by the injection means of FIG. 4 wherein a gas has been injected along with the gellable fluid.

The injection of the gellable mass into the body of water and formation of an exposed section of gelled mass can be achieved by other means, for example the embodiment illustrated in FIGS. 4–6, wherein a gas is also injected along with the gellable fluid.

As illustrated in FIG. 4, a barge or other floating vessel 33 may be pulled by a water-borne vessel or tug boat 35. The barge 33 carries the cross-linkable polymer and cross-linking agent and means for forming the gellable fluid. Carried by the barge 33 is a hollow injection box 37, the box 37 attached to the barge 33 by attachment means 39. The hollow injection box 37 is closed on the side 41 facing the barge 33 and on its opposite side 43. Both side walls 45 of the hollow injection box, have a plurality of apertures 47 therein, transverse to the direction of movement of the barge 33. The gellable fluid is directed from the barge 33 to the injection box 37 through conduits 49 and 51. To the gellable fluid entering the injection box 37 through conduit 51, there is added small particle size solid material, the reason for which is discussed hereinafter. There is also attached to the injection box 37 a plurality of downwardly extending gas conduits 53 which communicate with a gas conduit 55 that leads from the barge 33. A source of inert gas or air (not shown) is provided on the barge 33 to direct gas, under pressure, into the gas conduit 55. The lower sections 57 of the conduits 53 has means for injecting the gas into the gellable fluid as small bubbles. The location of the gas bubbles injection into the gellable mass, determined by the depth $h_1$ and $h_2$ below the surface of the body of water can vary from application to application but is preferably such than $h_2$ is a depth above the midpoint between the surface and the floor of the body of water.

In FIG. 4, the line 59 shows a transient position of the edge of the gellable fluid in the water during formation of the gelled mass. The rate of injection of the gellable fluid into the water from injection box 37 is approximately the same at any unit surface area of the sides of the box containing the apertures 47, with the velocity of the vessel being constant. At the injection plane a–d, the cross-linking process in the gellable fluid has begun, the fluid is relatively easily pumped and the gel has not set. At point b, the gellable fluid has travelled the distance between points d and b within a predetermined time period. The predetermined time period is the gellation time of the gellable fluid. The gellation time will depend on a number of factors such as, the type of polymer, concentration of the polymer and the cross-linking agent, the type of cross-linking agent, the type of water in the body of water, the temperature of the injected fluid, and the like.

An example may serve to better understand the gellation process in the body of water. Estimating that the length of the hollow injection box 37 is 20 feet (a–d) and the depth thereof is 10 feet, and the injection rate is 800 $ft.^3$/min., the following calculations can be made. The fluid velocity outwardly on either side of the hollow box 37, through apertures 47 is 800 $ft.^3$/min. divided by 400 $ft.^2$/min. = 2 ft./min. If the advance rate of the barge is 2 ft./min., the rear portion of the hollow box (d) will reach the previous front edge position (a) in 10 minutes. Thus, the maximum penetration of the gellable fluid into the body of water is 10 min. × 2 ft./min. = 20 ft. If the gellation time is 10 minutes, the vessel will leave behind it a gel mass characterized by a completely set gel in the line b–c and a partially gelled fluid between a–b.

In FIG. 6, there is illustrated a cross-section of the gelled mass when gas bubbles have been injected into the gellable fluid through conduits 53, into the upper section of the gelled mass. The injected gas bubbles tend to rise but at the same time are carried outwardly with the gellable fluid. When the gellable fluid sets, the top section 61 is characterized by a dome shape, having an exposed convex contour-line 63.

In order to assure that the gel mass 17 which is formed will rest securely on the floor 5, of the body of water 3, it is preferable to increase the density of the gelled mass to a value that is sufficiently above the density of the water, which water may be fresh water, sea water, or a mixture thereof.

An increase in the density of the gelled mass is readily achieved by admixing a finely divided dense material, having a density greater than that of the water in which the gelled mass is formed, with the gellable fluid comprising of a gellable polymer, and cross-linking agent and water. After gelation, the dense material remains an integral part of the gel mass formed. The particular dense material may vary depending upon conditions of the locality where the artificial island is to be formed, and the availability of such materials. Examples of such dense materials includes fine sand, silica powder, clays, silts or other finely pulverized materials. Depending upon factors such as availability and economics, such dense materials may be carried on the ship or a separate vessel, or, preferably, the materials may be syphoned off from the floor of the body of water by syphon means carried by the ship or a separate vessel.

It is not essential that the concentration of the dense material be uniform throughout the entire cross-section of the gelled mass that is formed. As one embodiment, the dense material is incorporated only into that portion of the gelled mass between the floor of the body of water and the mid-point between the floor and the surface of the body of water, such that the lower section of the gelled mass is rendered more dense.

The amount of the dense material to be added would be a minor amount, based upon the weight of the gelled mass and, in most instances, an amount of less than about 10 percent by weight would be sufficient.

Figure 7:
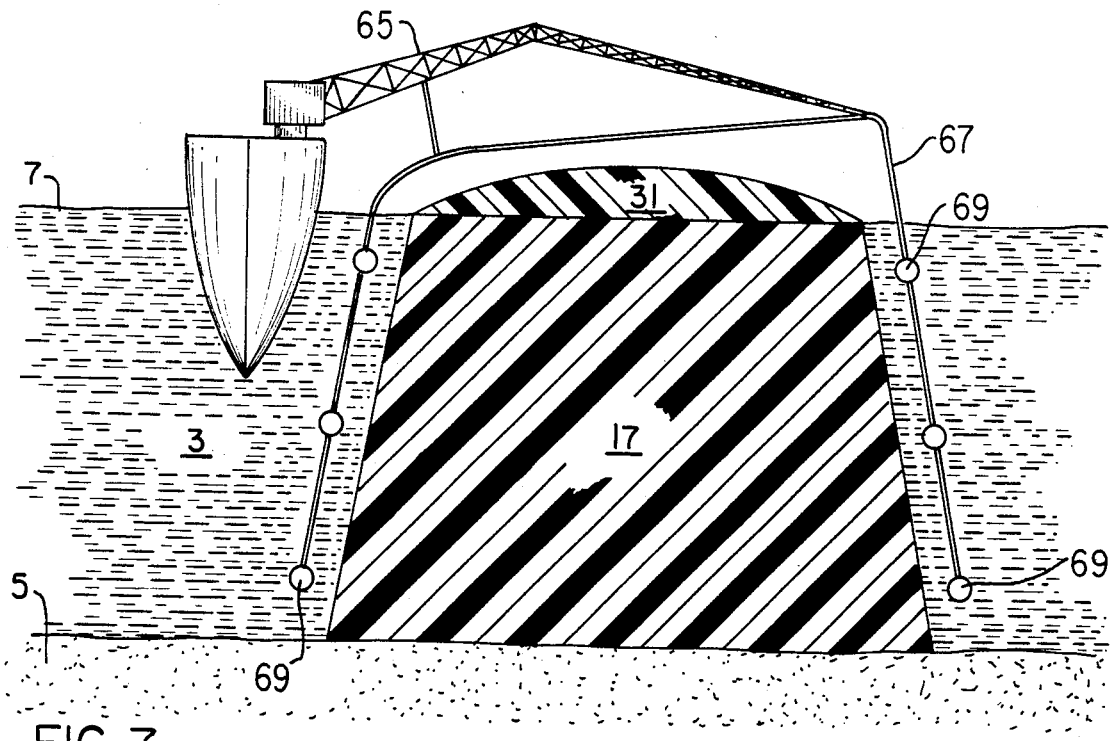
FIG. 7 illustrates placement of a protective covering over the strip of gelled mass.

With formation of the gelled mass 17, the edges of the gelled mass will have some elasticity. Upon collision with larger moving objects, such as ice flows, the edges can temperarily deform, but the original form is regained soon after the external forces are dissipated. The artificial island so formed will display resistance against any material erosion due to drifts in the body of water, because of the strong chemical bond between the individual polymer molecules. A problem may arise however, where the polymer material used could serve as a nutrient to fish or other aquatic animals. Thus, it is desirable to limit access to the gelled mass by such aquatic life. The gelled mass can therefore be covered, where desired, by a sheet of material to protect the same from the environment. As shown in FIG. 7, which shows the gelled mass of FIG. 3, one method for applying such a covering is by use of a vessel 63, equipped with a boom or crane 65, which will travel along the gelled mass 17, with its exposed portion 31, and place, over the gelled mass, sheets 67 of cloth, plastic screening, treated paper, rubber, or the like. Preferably, weights 69 would be attached to these sheets 67 to provide for lowering of the sheets 67 downwardly along the edges of the gelled mass 17.

In the formation of breakwaters or other artificial type islands which are in the form of a strip of gelled mass, the above described procedure, where the gelled mass, as a strip, is formed, a topping may be chemically bonded thereto, and optionally, a covering place thereover is sufficient to form that type of artificial island. In other instances, the use of the present method is effective to form an isolated section of water within a body of water or a solid load supporting artificial island. The direction of the ship, as it moves along the water, will determine the geometric shape of the final gel mass produced on the floor of the body of water, and such a shape can be greatly varied. In instances where a breakwater is to be formed, in the shape of a relatively straight or arcuate form, the length of the breakwater is readily determined by the length of formation of the gel mass.

Figure 8:
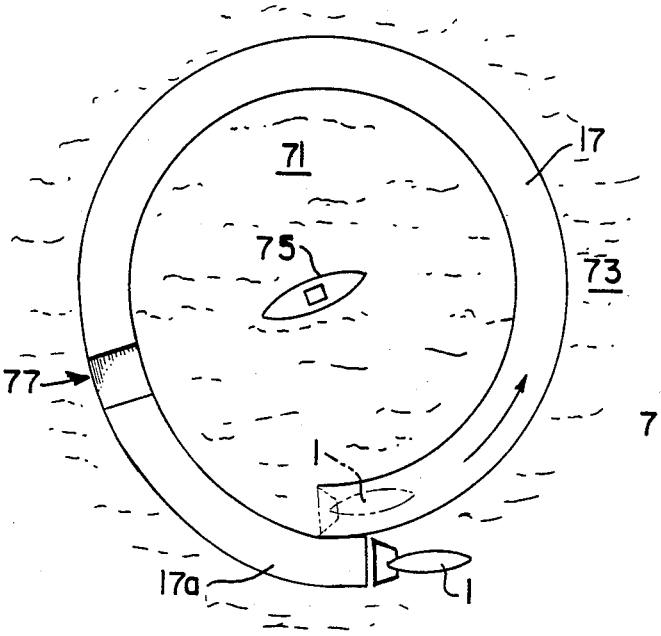
FIG. 8 illustrates a ship forming a strip of gelled mass in the form of a ring to substantially enclose a section of water.

In another embodiment, as illustrated in FIG. 8, the present method can be used to form an isolated or enclosed section of water 71 within a body of water 73 to protect a drill ship, or the like, against waves or ice movements in the remainder of the body of water. Formation of such an isolated section of water within a body of water may be desirable, for example, where an operator may want to drill an exploratory well for oil or gas, or the like, in a body of water that is exposed to high waves or strong ice movements without building a complete and solid island of earthen material or ice, or without the need for use of strong steel or concrete substructures.

Figure 9:
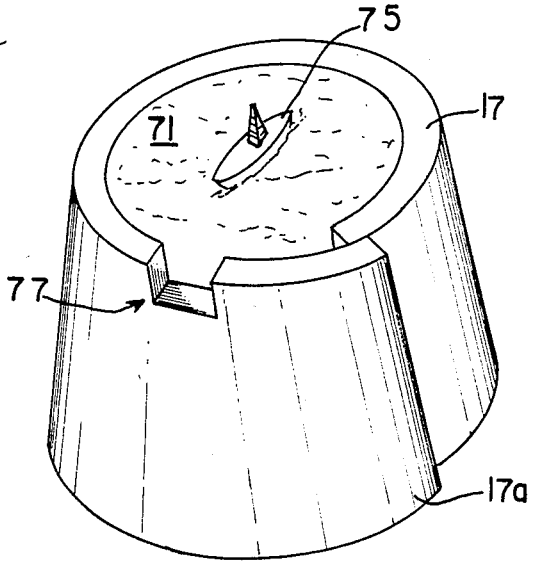
FIG. 9 is a schematic representation of the gelled mass produced in FIG. 8.

As illustrated in FIG. 8, the waterborne vessel 1, as shown in phantom, initiates the formation of the gelled mass 17 and travels in an arcuate or circular direction, as indicated by the arrow. The vessel 1, upon reaching again the starting point, forms an extension 17*a* of the gelled mass alongside the initially formed gelled mass 17 to form the enclosed section of water 71. In order to permit ingress and egress of a drill ship 75 or the like from the enclosed section of water 71, a passage 77 is left open in the gel mass 17. The passage 77 can be formed in a number of ways, for example not injecting the gellable fluid at that location, by closing the injection nozzles 13 at that area of the formation of the gelled mass 17, or providing for adjustment in the shape of the framework 9 carried by the ship 1 to leave the passage. In case of the use of hollow box 37 as injection means, a temporary covering of the holes at the top section of the hollow box can serve the same purpose. A schematic view of the structure so formed is illustrated in FIG. 9.

Figure 10:
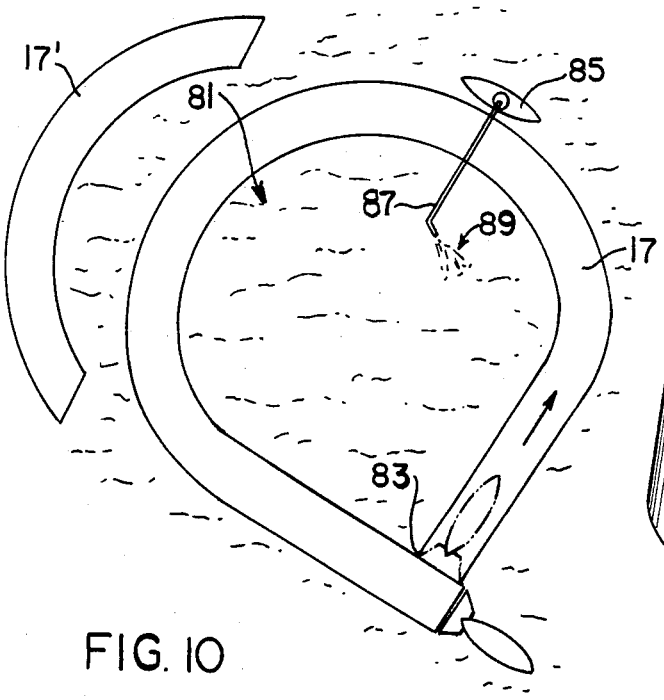
FIG. 10 illustrates a ship forming a strip of gelled mass in another form of a ring to enclose a section water.
Figure 11:
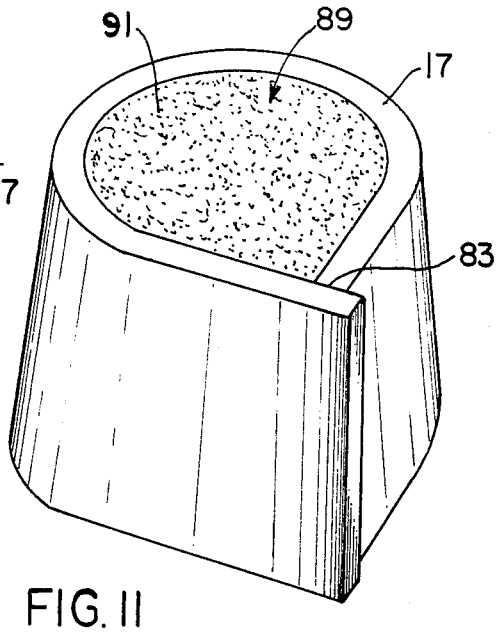
FIG. 11 is a schematic representation of the gelled mass produced in FIG. 10 with the water in the enclosed section displaced with solid material, to form an artificial island comprising a strip of gelled mass and a core of solid material.

Another primary purpose of the present invention is to form a structurally sound artificial island in a body of water, which will be load supportive and will enable the island to be used as a structurally sound mass. Referring to FIG. 10, after an enclosed section of water 81 has been formed, but without a passage or channel formed in the gelled mass, the section of water 81 will be completely enclosed by a ring of gelled mass 17. In this instance, the vessel 1 originally starts (in phantom) and forms a circle of gelled mass 17, with passage across the initial point 83 to close off the section of water 81. A further vessel 85 moves to the outer periphery of the gelled mass and carries a large volume of solid filler material, either in dry, suspended, or wet mass form. This filler material is discharged from the vessel 85, by means of a conveyor, pipe system or the like 87 and the material 89 dumped into the enclosed section of water 81. As the filler 89 is discharged into the enclosed area 81, it will displace an equal volume of water, which displaced water flows over the top of the gelled mass 17 into the surrounding body of water. The vessel 85 may start at one location and travel about the ring of gelled mass 17, or it may feed the filler material at one location, preferably around the midpoint of the enclosed section of water 81. Upon complete filling of the ring of gelled mass 17, the resulting mass will comprise a strip or ring of gelled mass 17 and an inner core of solid material 91. It may be desirable, upon filling the inner core of the gelled mass ring 17 with filler material to also add a coagulant along with the filler material. Such coagulants as low molecular weight surface active agent or polyelectrolytes would tend to aggregate the very fine particles of the filler material, thus increasing their settling rate. Thus, a larger portion of fine particles would settle along with large particles and remain embedded in the inner core 91. The concentration of such coagulants will depend upon the nature of the filler material, but will preferably be less than 200 parts per million based upon the liquid volume of the filler mass. If further strengthening of the filler material is desired, a grout material, such as cement, or the like may be injected into areas of the core 91. The resulting mass, as schematically illustrated in FIG. 11, comprises an artificial island which can be used to support drilling equipment or the like. While the drawings illustrate the use of a ship to fill the core of a circle of gelled mass with solid material, the material could be added by other means, for example dumped from trucks in areas where ice roads could be formed.

As also illustrated in FIG. 10, in areas where strong drifts may be expected from a particular direction, a strip of gelled mass 17' may be placed adjacent the gelled mass 17 to act as a breakwater or protective barrier.

A further embodiment of the present invention is to provide a solid, load supportive mass without the need for actually filling the volume of inner core with solid granular material. This goal can easily be achieved in polar regions where permafrost exists. In arctic areas for example, the sea is open only for a short duration of time, and the rest of the year, it is covered by a sheet of ice. Under this ice sheet, the water is in a constant state of motion due to underwater currents, therefor neither this water nor the top section of the sea floor freezes. Nevertheless, at any large area under which the water is practically stagnant, the water can freeze to a great depth. Examples of such are the naturally occuring islands, within which the ground water is frozen below the sea level, or the stagnant water body 71 in the present invention surrounded by a gel mass 17. This water, partly because it is stagnant, and partly because it is shielded from the heat transfer from the surrounding sea water by the thick gel mass 17, would freeze to a much greater depth than that of the surrounding water body.

In order to achieve an even greater rate of growth of said ice sheets the enclosed section of water 71, an operator may choose to pump up the underlying water above the level of the ice sheet which has naturally formed and spreading on it. Thus, this water can more rapidly freeze exposed to a colder environment. As the thickness of the ice sheet grows within the enclosed section of water 71, an ice mass is formed. The more water is pumped above the surface of the naturally formed ice sheet, the thicker the ice sheet becomes. Thus, within the inside perimeter of the gelled mass 17, a mass of ice is formed, capable of carrying heavy loads, such as required for drilling and production equipment. The operator may want to spill sea water sucked from below the surface of said ice sheet not only onto the top of the ice sheet within the perimeter of gel ring 17, but also onto the top of the gelled mass 17. Moreover, the user of the present invention may also want to spill water obtained from the surrounding body on the top of the gelled mass 17. Similarly, an operator may want to spill water from below the naturally formed ice sheet in the area between gel masses 17 and 17' on the top of said ice sheet and gel masses for forming an even bigger ice mass.

The selection of a particular water-soluble polymer and water-soluble cross-linking agent therefore will depend upon the environment into which the gellable material is to be dispersed. Any water-soluble polymer, which can be cross-linked under the conditions present where the gelled mass is to be formed, is usable.

As examples of such water-soluble polymers, there are the polyacrylamides, partially hydrolyzed polyacrylamides, copolymers of acrylamide and 2-acrylamide 2-methyl propane sulfonate (AM/AMPS copolymers), partially hydrolyzed versions of AM/AMPS copolymers, AMPS homopolymer (2-acrylamide 2-methyl propane sulfonate), diacetoneacrylamide, and terpolymers of the former polymers; carboxymethylcellulose; any cross-linkable cellulose derivative polymers; starch-acrylamide graft copolymers with ionic content; dextran-g-poly(acrylamides); N-substituted polyacrylamides, acrylic polymers prepared by polymerization of a carboxylic acid and acrylic esters; sulfonated polystyrene, cellulose ether-polyacrylamides such as disclosed in U.S. Pat. No. 4,043,921; cross-linkable biopolymers; cross-linkable cationic polymers; and the like.

The use of other water soluble materials which are not technically polymeric, but can be cross-linked by themself or with any water soluble polymer to form a cross-linked gel are usable when practicing the present invention. An example for such materials are the lignosulfonates, silicate solutions and the like.

Cross-linking agents can be any organic or inorganic material which is capable of cross-linking the selected polymer(s). Among inorganic cross-linking agents, those are preferred which contain a trivalent ion in solution. As an example, an operator may choose to admix a solution of Cr(VI) salt with the polymer solution. When this mixture is further admixed with a solution of a reducing agent (such as sodium bisulfite, thiourea and the like), trivalent $Cr^{+++}$ ions are formed which then in turn cross-link the polymer.

The concentration of the polymer used in the gellable fluid would depend on a number of factors, such as the type of polymer, price thereof, salinity of the water and the ambient temperature. It is however, preferred to use less than 5 weight percent polymer based on the weight of the gellable fluid, and more preferably a concentration range from 0.5 to 1.5 weight percent.

A further embodiment of the present invention is to inject into the water body a monomer of synthetic polymer which can be polymerized and cross-linked in said water body to form a gelled mass. When this alternate route for forming a gelled mass is used, the monomer is simultaneously injected with a suitable catalyst, initiator and a cross-linking agent. A typical example of an acrylamide monomer could be the use of DMAPN as catalyst, amonium persulfate as initiator, a potassium ferricyanide as a reaction control agent and N,N[1]-Methylenebisacrylamide as a cross-linking agent. Extensive literature is available on such polymerization-gellation process, such as the AM-9 Chemical Grout Treatment from American Cyanamide.

The use of the present method provides for the formation of breakwaters and artificial islands, and more specifically artificial islands comprised of a circular strip of gelled mass and a core of solid material, which may be either a granular material or frozen water.

What is claimed is:

1. A method for forming an artificial island in a body of water, said artificial island comprising a barrier which extends from the floor of the body of water to adjacent the surface of the body of water, comprising:

providing a waterborne vessel having means thereon for injecting a cross-linkable, gel-forming material, below the surface of said water;

injecting into said body of water said cross-linkable gel-forming material from said vessel, such that said cross-linkable gel-forming material will blend with the water and cross-link to form a stable cross-linkable gelled mass extending from the floor to the surface of said body of water; and moving said vessel while continuing said injection to form a strip of said stable cross-linked gelled mass, which comprises said barrier, the bottom of which rests upon the floor of the body of water and the top of which reaches to the surface of said body of water.

2. The method for forming an artificial island as defined in claim 1 wherein said cross-linkable, gel-forming material comprises:

(a) an aqueous solution of cross-linkable material selected from at least one polymer, or mixture thereof, which will form a cross-linked polymeric material; and (b) a cross-linking agent capable of cross-linking said cross-linkable material to form said stable cross-linked gelled mass.

3. The method for forming an artificial island as defined in claim 2 wherein said cross-linkable, gel-forming material consists essentially of a polymer which will from a stable cross-linked polymeric gelled mass.

4. The method for forming an artificial island as defined in claim 1 wherein a dense material, having a density greater than the density of said water, is incorporated within the gelled mass.

5. The method for forming an artificial island as defined in claim 4 wherein said dense material is incorporated in an amount of less than ten percent by weight based upon the weight of the gelled mass.

6. The method for forming an artificial island as defined in claim 4 wherein said dense material is incorporated only into that portion of the gelled mass between the floor and the mid-point between the floor and the surface of the body of water.

7. The method for forming an artificial island as defined in claim 1 wherein the cross-section of said gelled mass adjacent the floor of said body of water is greater than the cross-section of said gelled mass adjacent the surface thereof.

8. The method for forming an artificial island as defined in claim 1 wherein a partially aged cross-linkable, gel-forming material, that is cross-linkable with said injected material, is discharged onto the top surface of said gelled mass prior to complete setting of the top portion said gelled mass, such that said discharged cross-linkable gel-forming material will react with said top portion to form a chemically bonded exposed gelled mass extending from said body of water.

9. The method for forming an artificial island as defined in claim 8 wherein said partially aged cross-linkable gel-forming material discharged onto said top surface, is discharged from said waterborne vessel.

10. The method for forming an artificial island as defined in claim 1 wherein said gelled mass is covered by a sheet material to protect the same from the environment.

11. The method for forming an artificial island as defined in claim 1 wherein said strip of gelled mass is formed to serve as a breakwater.

12. The method for forming an artificial island as defined in claim 1 wherein said vessel is moved in a circular pattern so as to form a substantially enclosed section of water surrounded by said strip of gelled mass.

13. The method for forming an artificial island as defined in claim 12 wherein said strip of gelled mass has an opening formed therein for ingress and egress of a waterborne vessel to said section of water.

14. The method for forming an artificial island as defined in claim 1 wherein said vessel is moved in a circular pattern so as to form an enclosed section of water surrounded by said strip of gelled mass.

15. The method for forming an artificial island as defined in claim 14 wherein said section of water is enclosed within said strip of gelled mass and wherein solid material is discharged into said enclosed section of water to displace at least a portion of the water therefrom and form an artificial island comprising said strip of gelled mass and a core of solid material.

16. The method as defined in claim 15 wherein said solid material is discharged from a vessel located outside said enclosed section of water and strip of gelled mass.

17. The method for forming an artificial island as defined in claim 14 wherein said strip of gelled mass is formed in an environment where freezing of the water in the body of water occurs, and wherein the upper portion of said enclosed section of water is permitted to freeze, to form an ice layer, and water from the lower portion of said enclosed section of water is pumped from below said ice layer, and water is poured onto the top of said ice layer and permitted to freeze to increase the thickness of said ice layer, and also onto the top of the strip of said gelled mass.

18. The method for forming an artificial island as defined in claim 1 wherein a gas is injected into the cross-linkable gel-forming material, at the upper region of said gelled mass as said mass is being formed.

19. A method for forming an artificial island in a body of water, said artifical island comprising a barrier which extends from the floor of the body of water to adjacent the surface of the body of water, comprising:

providing a waterborne vessel having means thereon for injecting a cross-linkable, gel-forming material below the surface of said water;

injecting into said body of water said cross-linkable, gel-forming material from said vessel, such that said cross-linkable, gel-forming material will blend with the water and cross-link to form a stable, cross-linked gelled mass extending from the floor to the surface of said body of water;

moving said vessel in a circular pattern while continuing said injection to form an enclosed section of water surrounded by said strip of gelled mass which comprises said barrier, the bottom of which rests upon the floor of the body of water and the top of which reaches to the surface of said body of water;

discharging onto the top surface of said gelled mass, prior to complete setting of the top portion of said gelled mass, a partially aged cross-linkable, gel-forming material that is cross-linkable with said injected material, such that said discharged cross-linkable, gel-forming material will react with said top portion to form an exposed chemically bonded gelled mass extending from said body of water; and discharging solid material into said enclosed section of water to displace water therefrom and form an artificial island comprising said strip of gelled mass, exposed gelled mass, and a core of solid material.

* * * * *